US006441737B1

(12) United States Patent
Antonenco et al.

(10) Patent No.: US 6,441,737 B1
(45) Date of Patent: Aug. 27, 2002

(54) GLASS-COATED AMORPHOUS MAGNETIC MICROWIRE MARKER FOR ARTICLE SURVEILLANCE

(75) Inventors: Alexandru Antonenco, Kishinev (MD); Edward Brook-Levinson, Petah Tikva (IL); Vladimir Manov, Haifa (IL); Evgeni Sorkine, Tel Aviv (IL); Yuri Tarakanov, Haifa (IL)

(73) Assignee: Advanced Coding Systems Ltd., Even Yehuda (IL)

( * ) Notice: Subject to any disclaimer, the term of this patent is extended or adjusted under 35 U.S.C. 154(b) by 69 days.

(21) Appl. No.: 09/658,868

(22) Filed: Sep. 8, 2000

(30) Foreign Application Priority Data

Sep. 10, 1999 (IL) ..... 131866

(51) Int. Cl.[7] ..... G08B 13/14

(52) U.S. Cl. ..... 340/572.1; 340/551; 140/300; 140/304

(58) Field of Search ..... 340/572.1, 551, 340/552, 572.6; 148/300, 301, 302, 303, 304; 428/379, 611, 678, 679, 681, 928

(56) References Cited

U.S. PATENT DOCUMENTS 4,484,184 A 11/1984 Gregor et al.
5,001,018 A * 3/1991 Takada ..... 428/611
5,519,379 A 5/1996 Ho et al.
5,801,630 A 9/1998 Ho et al.
6,229,445 B1 * 5/2001 Wack ..... 340/572.7
6,270,591 B2 * 8/2001 Chiriac ..... 148/300

FOREIGN PATENT DOCUMENTS

EP 0 316 811 5/1989
WO 98 20467 5/1998

OTHER PUBLICATIONS

Antonenko et al., "High frequency properties of glass–coated microwire", *Journal of Applied Physics*, (1998), vol. 83, No. 11, pp. 6587–6589.

Donald et al., "The preparation, properties and applications of some glass–coated filaments prepared by the Taylor–wire process 0", *Journal of Materials Science*, (1996) vol. 31, pp. 1139–1149.

Wesner et al., "Magnetic Properties of Amorphous Fe–P Alloys Containing Ga, Ge and As", *Physica Status Solidi*, (1974), vol. 26, No. 71, pp. 71–75.

* cited by examiner

*Primary Examiner*—Anh La
(74) *Attorney, Agent, or Firm*—Browdy and Neimark

(57) ABSTRACT

A magnetic marker for use in an article surveillance system, and an electronic article surveillance system utilizing the same are presented. The marker comprises a magnetic element formed by at least one microwire piece made of an amorphous metal-containing material coated with glass. The microwire piece has substantially zero magnetostriction, coercivity substantially less than 10 A/m, and permeability substantially higher than 20000.

22 Claims, 2 Drawing Sheets

GLASS-COATED AMORPHOUS MAGNETIC MICROWIRE MARKER FOR ARTICLE SURVEILLANCE

FIELD OF THE INVENTION

The present invention is in the field of article surveillance techniques and relates to a magnetic marker for use in an electronic article surveillance system (EAS).

BACKGROUND OF THE INVENTION

Magnetic markers are widely used in EAS systems, due to their property to provide a unique non-linear response to an interrogating magnetic field created in a surveillance zone. The most popularly used markers utilize a magnetic element made of soft magnetic amorphous alloy ribbons, which is typically shaped like an elongated strip. A marker of this kind is disclosed, for example, in U.S. Pat. No. 4,484,184. This strip-like marker usually is of several centimeters in length and a few millimeters (or even less then a millimeter) in width.

It is a common goal of marker designing techniques to decrease the marker dimensions and to enhance the uniqueness of its response. Additionally, it is desirable to increase the marker flexibility so as to enable its attachment to various flexible and flat articles like clothes, footwear, etc. in a concealed manner. For these purposes, a magnetic element in the form of a thin wire is preferable over that of a strip.

U.S. Pat. No. 5,801,630 discloses a method for preparing a magnetic material with a highly specific magnetic signature, namely with a magnetic hysteresis loop having large Barkhausen discontinuity at low coercivity values, and a marker utilizing a magnetic element made of this material. The material is prepared from a negative-magnetostrictive metal alloy by casting an amorphous metal wire, processing the wire to form longitudinal compressive stress in the wire, and annealing the processed wire to relieve some of the longitudinal compressive stress. However, a relatively large diameter of the so-obtained wire (approximately 50 $\mu$m) impedes its use in EAS applications. Additionally, a complicated multi-stage process is used in the manufacture of this wire. Furthermore, amorphous wire brittleness unavoidably occurs, due to the wire-annealing process. Such brittleness will prevent the use of the wire in flexible markers.

A technique for manufacturing microwires known as Taylor-wire method enables to produce microwires having very small diameters ranging from one micrometer to several tens micrometers by a single-stage process consisting of a direct cast of a material from melt. Microwires produced by this technique may be made from a variety of magnetic and non-magnetic alloys and pure metals. This technique is disclosed, for example, in the article "*The Preparation, Properties and Applications of Some Glass Coated Metal Filaments Prepared by the Taylor-Wire Process*", W. Donald et al., Journal of Materials Science, 31, 1996, pp. 1139–1148.

The most important feature of the Taylor-wire process is that it enables to produce metals and alloys in the form of a glass-coated microwire in a single operation, thus offering an intrinsically inexpensive way for the microwire manufacture.

A technique of manufacturing magnetic glass-coated microwires with an amorphous metal structure is described, for example, in the article of "*Magnetic Properties of Amorphous Fe-P Alloys Containing Ga, Ge and As*", H. Wiesner and J. Schneider, Phys. Stat. Sol. (a) 26, 71 (1974).

The properties of amorphous magnetic glass-coated microwires are described in the article "High Frequency Properties of Glass-Coated Microwires", A. N. Antonenko et al, Journal of Applied Physics, vol. 83, pp. 6587–6589. The microwires cast from alloys with small negative magnetostriction demonstrate flat hysteresis loops with zero coercivity and excellent high frequency properties. The microwires cast from alloys with positive magnetostriction are characterized by ideal square hysteresis loops corresponding to their single-domain structure.

SUMMARY OF THE INVENTION

There is accordingly a need in the art to facilitate the article surveillance by providing a novel magnetic marker to be used in EAS system.

It is a major feature of the present invention to provide such a marker that has minimum dimensions, while maintaining the necessary level of response to an interrogating magnetic field.

It is a further feature of the present invention that the marker has highly unique response characteristics.

It is a still further feature of the present invention that the marker is extremely flexible, and can therefore be introduced to articles made of fabrics and having a complex shape.

The main idea of the present invention is based on the use of amorphous metal glass-coated magnetic microwires with substantially zero magnetostriction, very low coercivity (substantially less than 10 A/m) and high permeability (substantially higher than 20000) to form a magnetic element of a marker. The present invention takes advantage of the use of the known Tailor-wire method for manufacturing these amorphous glass-coated magnetic microwires from materials enabling to obtain the zero magnetostriction.

Although amorphous magnetic glass-coated microwires and their manufacture have been known for a long time, no attempts were made for using them in magnetic elements of EAS markers. These amorphous magnetic glass-coated microwires, however, have good mechanical strength, flexibility, and corrosion resistance, and can therefore be easily incorporated in paper, plastic, fabrics and other article materials.

There is thus provided according to one aspect of the present invention, a magnetic marker for use in electronic article surveillance (EAS) system, the marker comprising a magnetic element formed by at least one microwire piece made of an amorphous metal-containing material coated with glass, the microwire piece having substantially zero magnetostriction, coercivity substantially less than 10 A/m and permeability substantially higher than 20000.

Preferably, the microwire piece is manufactured by a single-stage process of direct cast from melt (i.e., Tailor-wire method). The microwire (its metal core) has a desirably small diameter, (e.g., several micrometers) substantially hot exceeding 30 $\mu$m. The properties of the microwire piece are controlled by varying the metal-containing material composition and the glass-to-metal diameter ratio.

The microwire piece comprises a core, made of the metal-containing material, and the glass coating. The metal core and the glass coating may be either in continuous contact or may have only several spatially separated points of contact.

Preferably, the metal containing material is a cobalt-base alloy. For example Co—Fe—Si—B alloy (e.g., containing 77.5% Co, 4.5% Fe, 12% Si, and 6% B by atomic percentage), Co—Fe—Si—B—Cr alloy (e.g., containing 68.7% Co, 3.8% Fe, 12.3% Si, 11.4% B, and 3.8% Cr by atomic percentage), or Co—Fe—Si—B—Cr—Mo alloy (e.g., containing 68.6% Co, 4.2% Fe, 12.6% Si, 11% B, 3.52% Cr and 0.08% Mo by atomic percentage) may be used. The microwire piece made of the Co—Fe—Si—B—Cr—Mo alloy shows less sensitivity to external mechanical tensions, due to the fact that in this microwire the metal core and glass coating are physically attached to each other only in several spatially separated points of contact, rather than being in continuous contact.

According to one embodiment of the invention, the marker is in the form of a strip, formed by several parallel microwire pieces enclosed between substrate and cover layers. The substrate and cover layers are, preferably, manufactured by a co-extrusion process.

According to another embodiment of the invention, the magnetic element is in the form of a plurality of the microwire pieces twisted in a thread, and optionally comprises auxiliary non-magnetic reinforcement fibers. Preferably, the thread is soaked with an elastic binder.

According to yet another embodiment of the invention, the magnetic element is formed by a plurality of the microwire pieces aligned in a bundle and assembled in a thread by winding non-magnetic auxiliary fibers. The auxiliary fibers may either partly on entirely cover the outer surface of the bundle.

According to another aspect of the present invention, there is provided an electronic article surveillance system utilizing a market mounted within an article to be detected by the system when entering an interrogation zone, the system comprising a frequency generator coupled to a coil for producing an alternating magnetic field within said interrogation zone, a magnetic field receiving coil, a signal processing unit and an alarm device, wherein said marker comprises a magnetic element formed by at least one microwire piece made of an amorphous metal-containing material coated with glass, the microwire piece having substantially zero magnetostriction, coercivity substantially less than 10 A/m and permeability substantially higher than 20000.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF A PREFERRED EMBODIMENT

Figure 1:
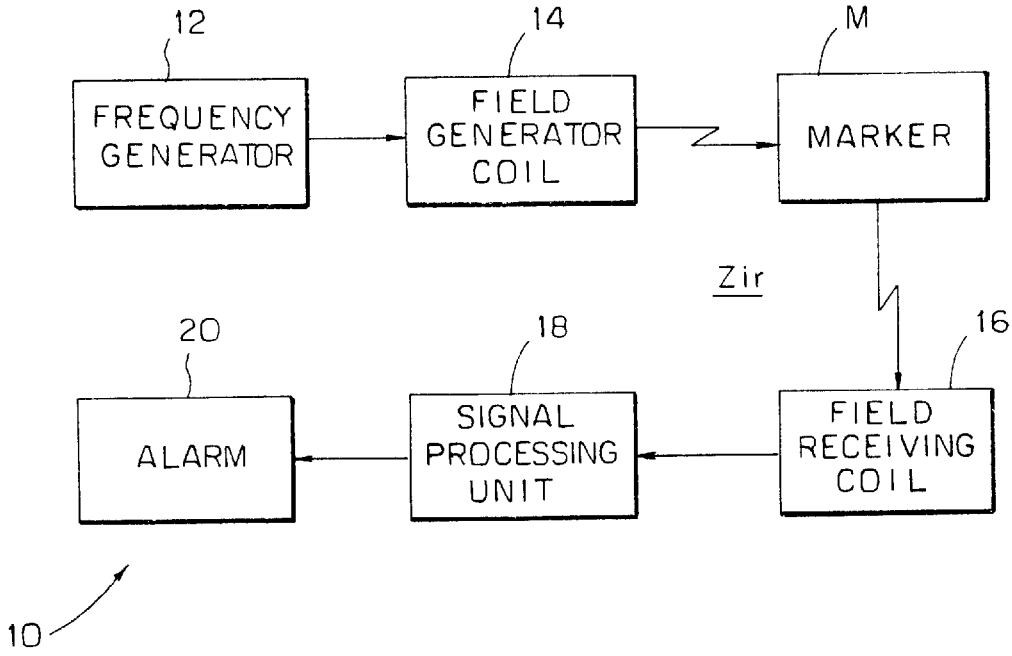
FIG. 1 is a schematic block diagram of a conventional EAS system.

Referring to FIG. 1, a block diagram of the main components typically included in an EAS system 10 is illustrated. The system 10 comprises a frequency generator block 12 and a coil 14 producing an alternating magnetic field within an interrogation zone $Z_{in}$. Further provided in the system 10 are the following elements: a field receiving coil 16, a signal processing unit 18 and an alarm device 20.

The system 10 operates in the following manner. When an article carrying a magnetic marker M enters the interrogation zone $Z_{in}$, the non-linear response of the marker to the interrogating field process perturbations to the signal received by the field receiving coil 16. These perturbations, which may for example be higher harmonics of the interrogation field signal, are detected by the signal processing unit 18, which generates an output signal that activates the alarm device 20.

Figure 2:
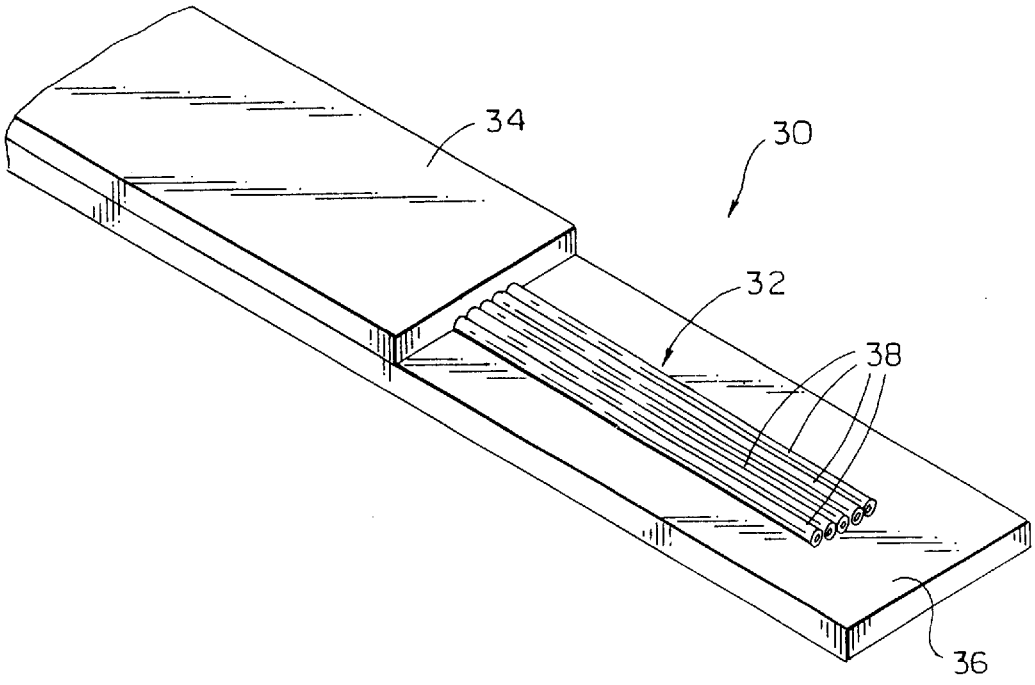
FIG. 2 schematically illustrates a magnetic marker constructed according to one embodiment of the invention.

Reference is now made to FIG. 2, illustrating a marker 30 constructed according to one embodiment of the present invention suitable to be used in the system 10. The marker 30 includes a magnetic element 32 sandwiched between a substrate layer 34 and a cover layer 36. The magnetic element 32 is formed by several parallel magnetic amorphous glass-coated microwire pieces, generally at 38. It should, however, be noted that a single microwire piece, as well as any other suitable number of wicrowire pieces, could be used. Generally, the number of such microwire pieces is dictated by the requirements of the specific application, namely the required sensitivity of EAS system and the length of the marker's magnetic element. It is known that the longer the magnetic element of the marker, the less the sensitivity value of the system, which is sufficient for the detection of the marker-associated article.

The outer surface of the substrate 34 may be formed with a suitable adhesive coating to secure the marker 30 to an article (not shown) which is to be monitored. A barcode label or the like may be printed on the outer surface of the cover layer 36.

The substrate and cover layers 34 and 36 may be manufactured by the known co-extrusion process. This enables to produce the marker 30 with the width of few tenths of millimeters, which is very convenient for hiding it inside the article to be maintained under surveillance. As for the glass-coated magnetic microwire piece 38, it is manufactured by utilizing a direct cast from the melt technique, known as Taylor-wire method. The so-prepared glass-coated magnetic microwire piece 18 is characterized by small coercivity (substantially less than 10 A/m) and high permeability values (substantially higher than 20000).

The inventors have found that such a microwire can be manufactured from amorphous alloys having zero magnetostriction. The hysteresis loops of this microwire may be similar to that of die-drawn amorphous wires disclosed in the above U.S. Pat. No. 5,801,630. However; according to the principles of the present invention, no additional processing is needed after the microwire casting. The microwire properties can be controlled by varying the alloy composition and the glass-to-metal diameter ratio.

Figure 3:
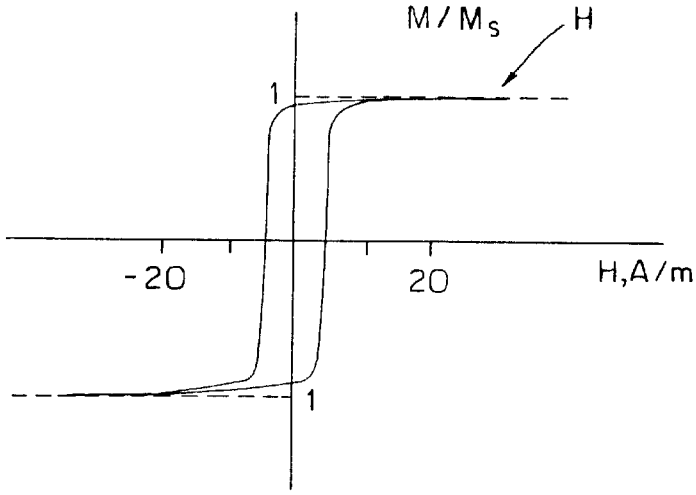
FIG. 3 graphically illustrates the main characteristic of the marker's magnetic element.

Following are three examples of the microwire piece manufactured according to the invention and tested:

(1) The microwire is made of an alloy containing 77.5% Co, 4.5% Fe, 12% Si, and 6% B by atomic percentage. FIG. 3 illustrates a hysteresis loop H measured in such a microwire sample. In the present example, the diameter of the inner metal part (core) is about 15–20 $\mu$m. The total diameter of the microwire sample (inner metal part and the glass coating) is about 17–22 $\mu$m. As shown, the hysteresis loop H has a small coercivity value, namely less than 10 A/m, and large Barkhausen discontinuity, that is, a high permeability value (higher than 20000).

(2) The microwire is made of Co—Fe—Si—B—Cr alloy containing 68.7% Co, 3.8% Fe, 12.3% Si, 11.4% B, and 3.8% Cr by atomic percentage.

(3) The microwire is made of Co—Fe—Si—B—Cr—Mo alloy containing 68.6% Co, 4.2% Fe, 12.6% Si, 11% B, 3.52% Cr and 0.08% Mo by atomic percentage. Some important features of this microwire will be described further below with reference to FIG. 6.

Other microwire samples were tested by the inventors, the samples being manufactured from the Co—Fe—Si—B alloys generally similar to the above composition, but with small variations of the contents of iron, i.e. within ±0.05%. The outer diameter of the microwire was about 22–25 $\mu$m, and the diameter of its metal core was about 16–20 $\mu$m. The shapes of the measured hysteresis curves of the microwire samples were similar to that shown in FIG. 3. The coercive force values were about 2–10 A/m (0.03–0.12 Oe).

Figure 4:
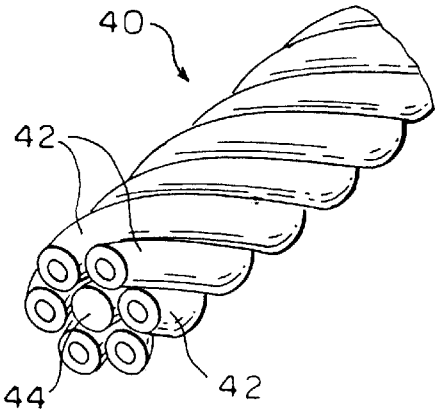
FIG. 4 is a schematic illustration of a magnetic marker constructed according to another embodiment of the invention.

FIG. 4 illustrates a magnetic marker 40 constructed according to another embodiment of the invention. In the marker 40, a magnetic element is in the form of a plurality of microwire pieces 42 twisted in a thread. Such a thread may be manufactured by the known textile methods, and may utilize non-magnetic reinforcement fibers 44 (e.g., polyester fibers). To improve the mechanical performance of the marker, the thread may be soaked with an appropriate elastic binder.

It should be noted that such a thread-like magnetic element may be manufactured by arranging a plurality of non-magnetic reinforcement fibers to form a conventional sewing thread, the magnetic glass coated microwires being concealed in the plurality of fibers. This design is convenient for embedding the magnetic markers in the articles made of fabrics, e.g., clothing.

Figure 5:
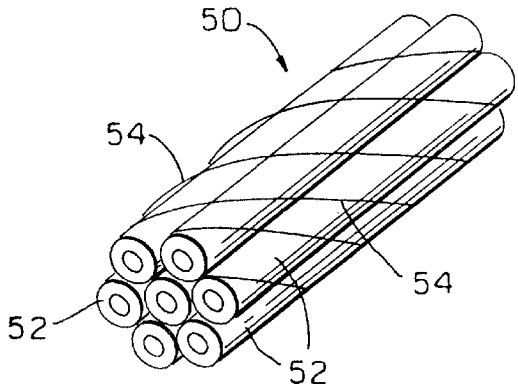
FIG. 5 is a schematic illustration of yet another embodiments of the invention.

FIG. 5 illustrates yet another embodiment of the present invention. A thread-shaped magnetic marker 50 comprises a bundle of parallel, untwisted microwire pieces 52 that are assembled in a thread by winding auxiliary non-magnetic fibers 54 around the bundle. In this example, the auxiliary fibers 34 only partly cover the external surface of the marker 52. It should however be noted that the auxiliary fibers 54 could cover the entire external surface of the marker, so that it will look like a usual sewing thread which is advantageous for embedding the marker in articles made of fabrics.

It should also be noted that the mechanical performance of the marker can be improved by additionally coating the microwire pieces with plastic polymer materials, such as polyester, Nylon, etc. The coating may be applied to separate microwires and/or to entire microwire bundle.

Figure 6:
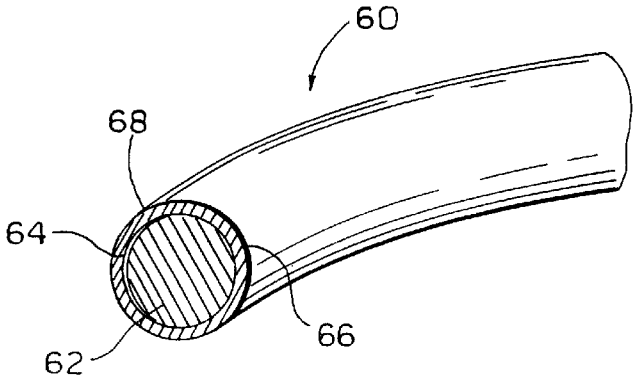
FIG. 6 illustrates more specifically some constructional principles of the microwire piece suitable to be used in the marker of either of FIGS. 2, 4 or 5.

FIG. 6 illustrates a microwire 60 to be used in either of the markers 20, 30 or 50. The microwire 60 is composed of a metal core 62 and a glass coating 64, wherein the metal core and the glass coating are physically coupled to each other solely in several spatially separated points—one point 66 being seen in the figure. In other words a certain gap 68 is provided between the core and the coating all along the microwire except for several points of contact.

As known, the microwire core metal may have continuous contact with the glass coat. In this case, the differences in thermal elongation of glass and metal result in considerable stresses created in the metal core 62. As disclosed in the above article by A. N. Antonenko et al., these stresses considerably affect the magnetic properties of the microwire. Additionally, the microwire is sensitive to external stresses created by its bending or twisting, which is undesirable for the purposes of the present invention, i.e., for use of the microwire in markers. It has been found by the inventors, that by controlling the conditions of a casting process, and by varying the metal alloy composition, it becomes possible to produce microwire with separate points of contact between the metal core and the glass coating, rather than being in continuous contact. Particularly, the Co—Fe—Si—B—Cr—Mo alloy of the above example (3) was used for manufacturing the microwire 60. Microscopic analysis of the produced microwire have shown that the small gap between the metal core and glass coating take place all along the microwire except for several spatially separated points of contact. The microwire of this construction possesses less sensitivity to external mechanical tensions, as compared to that of continuous physical contact between the metal core and glass coating.

The advantages of the present invention are self-evident. The use of amorphous glass coated microwires prepared from a magnetic material with substantially zero magnetostriction, very low coercivity and high permeability as the magnetic element of an EAS marker, enables to produce a desirably miniature and flexible marker suitable to be attached and/or hidden in a delicate article to be monitored. Moreover, the use of the Tailor-wire method for manufacturing such microwires significantly simplifies the manufacture and provides for desirably small thickness of the microwire.

The markers according to the present invention may be deactivated by the known methods, for example, those disclosed in the above-indicated U.S. Pat. No. 4,484,184, or by crystallizing some or all of the microwire metal cores by suitable microwave radiation.

Those skilled in the art will readily appreciate that various modifications and changes can be applied to the preferred embodiment of the present invention as hereinbefore exemplified, without departing from its scope defined in and by the appended claims.

What is claimed is:

1. A magnetic marker for use in an article surveillance system, the marker comprising a magnetic element formed by at least one microwire piece made of an amorphous metal-containing material coated with glass, the microwire piece having substantially zero magnetostriction, coercivity substantially less than 10 A/m, and permeability substantially higher than 20000.

2. The marker according to claim 1, wherein said at least one microwire piece is manufactured by a single-stage process of direct cast from melt.

3. The method according to claim 2, wherein said at least one microwire piece comprises a core, made of said metal-containing material, and the glass coating, the diameter of the core substantially not exceeding 30 $\mu$m.

4. The marker according to claim 1, wherein said at least one microwire piece comprises a core, made of said metal-containing material, and the glass coating, wherein the metal core and the glass coating are physically coupled to each other in several spatially separated points.

5. The marker according to claim 2, wherein the properties of said at least one microwire piece are controlled by varying the metal-containing material composition and the glass-to-metal diameter ratio.

6. The marker according to claim 1, wherein said metal containing material is a cobalt-based alloy.

7. The marker according to claim 6, wherein said cobalt-based alloy is an alloy of Co, Fe, Si and B.

8. The marker according to claim 7, wherein said cobalt-based alloy contains 77.5% Co, 4.5% Fe, 12% Si, and 6% B by atomic percentage.

9. The marker according to claim 6, wherein said cobalt-based alloy is an alloy of Co, Fe, Si, B and Cr.

10. The marker according to claim 9, wherein said cobalt-based alloy contains 68.7% Co, 3.8% Fe, 12.3% Si, 11.4% B, and 3.8% Cr by atomic percentage.

11. The marker according to claim 6, wherein said cobalt-based alloy is an alloy of Co, Fe, Si, B, Cr and Mo.

12. The marker according to claim 11, wherein said cobalt-based contains 68.6% Co, 4.2% Fe, 12.6% Si, 11% B, 3.52% Cr and 0.08% Mo by atomic percentage.

13. The marker according to claim 1, wherein said at least one microwire piece is accommodated between substrate and cover layers.

14. The marker according to claim 13, wherein a desired number of the microwire pieces are accommodated between said substrate and cover layers, the microwire pieces being aligned in a parallel relationship so as to form a strip.

15. The marker according to claim 13, wherein said substrate and cover layers are manufactured by a co-extrusion process.

16. The marker according to claim 1, wherein the magnetic element is in the form of a plurality of the microwire pieces twisted in a thread.

17. The marker according to claim 16, wherein said magnetic element comprises auxiliary non-magnetic reinforcement fibers.

18. The marker according to claim 16, wherein said thread is soaked with an elastic binder.

19. The marker according to claim 1, wherein said magnetic element is formed by a plurality of the microwire pieces aligned in a bundle and assembled in a thread by winding non-magnetic auxiliary fibers.

20. The marker according to claim 19, wherein auxiliary fibers cover the entire outer surface of the bundle.

21. The marker according to claim 19, wherein auxiliary fibers partly cover the outer surface of the bundle.

22. An electronic article surveillance system utilizing a marker mounted within an article to be detected by the system when entering an interrogation zone, the system comprising a frequency generator coupled to a coil for producing an alternating magnetic field within said interrogation zone, a magnetic field receiving coil, a signal processing unit, and an alarm device, wherein said marker comprises a magnetic element formed by at least one microwire piece made of an amorphous metal-containing material coated with glass, the microwire piece having substantially zero magnetostriction, coercivity substantially less than 10 A/m and permeability substantially higher than 20000.

* * * * *